United States Patent [19]

Henderson, Jr.

[11] Patent Number: 4,572,555

[45] Date of Patent: Feb. 25, 1986

[54] DEVICE USED FOR THE TYING OF A PROPER BOWLINE KNOT

[76] Inventor: Joseph R. Henderson, Jr., 9 Wilde Rd., Newton, Mass. 02168

[21] Appl. No.: 710,476

[22] Filed: Mar. 11, 1985

[51] Int. Cl.[4] ..... B65H 69/04

[52] U.S. Cl. ..... 289/17

[58] Field of Search ..... 289/2, 17

[56] References Cited

U.S. PATENT DOCUMENTS 1,210,845 1/1917 Roth ..... 289/17

1,446,525 2/1923 Tischhauser ..... 289/17

3,336,063 8/1967 Remmers ..... 289/2

3,591,217 7/1971 Melzer ..... 289/2

*Primary Examiner*—Louis K. Rimrodt

[57] ABSTRACT

Disclosed is a device which acts as a guide in forming a particular knot with rope, string, wire or other cordage. The guide consists of 2 pieces or lengths of a rolled, formed or shaped material, the top outer surface of which is concave (in the preferred embodiment) to hold the rope, string, wire or other cordage as the knot is being formed.

1 Claim, 3 Drawing Figures

DEVICE USED FOR THE TYING OF A PROPER BOWLINE KNOT

The invention relates to knot-tying devices or guides and more particularly to hand held knot-tying devices or guides, which assist or guide the user in the formation of a particular knot.

The embodiment of this invention acts as a guide for the user in forming a bowline knot, which knot has widespread application in many fields including nautical, sporting and heavy rigging. So widespread in use, in fact, that Charles F. Chapman in his book "Piloting, Seamanship and Small Boat Handling," while referring to the nautical applications of knots, says of the bowline: "The bowline is considered a knot second in usefulness only to the square knot."

At present, a person wishing to teach himself to tie this useful knot has only illustrations, photographs, and/or verbal descriptions from which to refere. We live in a 3-dimensional world; therefore, trying to produce a 3-dimensional result (knot) from a 2-dimensional field of reference (illustration or photo) can be difficult. For a simple knot, it can be confusing; for a complicated knot, mind-boggling. Moreover, the verbal descriptions are no less difficult for the average person. H. A. Callahan another well known authoritative source of nautical "how to," discusses in his book, "Sailing Technique," how to tie the all important bowline in Chapter 24, "A Few Simple Knots." After first defining the basic parts of a rope or a knot such as "Standing Part," "Fall" and "Bight," he proceeds with his description. Condensed, I quote:

> "Take the standing part in your left hand and the fall in your right hand, allowing enough space between the hands to form the bight you intend to tie. Face the line when you do this and hold it naturally with both thumbs and palms uppermost. The first part of this knot is tied almost entirely with the left hand. Hit the standing part above your left hand with the fall of the line held in your right hand. Then form a bight around the fall by moving your left hand above it, carrying with it the part that you have been holding and grasping it together with that part of the standing part that is above the right hand. Do not turn your left hand over in doing this. Simply pass it upwards and grasp the line again, thus forming a bight around the fall and doing it all with your left hand . . . . "

This is only the first part of the knot and be assured that knowing the definition of standing part, fall and bight make little difference in the complexity of trying to learn to tie this knot from a written description. This is in no way a criticism of Mr. Callahan's instructions as they, if followed, will produce a proper knot and, in fact, to one already familiar with the steps involved in tying a bowline knot the instructions are quite clear.

Eliminating all the present comprehension and dexterity difficulties and complexities faced by someone attempting to tie or to teach themselves to tie a bowline knot, the present invention enables those not already familiar with the steps involved in tying a bowline knot to accomplish this feat quickly, simply and accurately, Indeed, the present invention so simplifies the feat of tying a bowline knot, that even those possessing only basic comprehension and/or dexterity skills, such as young children, can now, in most cases, successfully accomplish this feat.

The principal object of this invention is to provide a simple hand held knot-tying guide or device which will enable the user to efficiently and expeditiously tie or learn how to tie the bowline knot.

It is also an object of this invention to provide a simple hand held knot-tying guide or device which, in and of itself, provides sufficient assistance to enable the user to correctly tie a proper bowline knot without reference to or assistance from any illustration, photograph and/or verbal description of the knot, and without any prior experience or prerequisite knowledge in knot tying.

It is a further object of the invention to provide a simple, practical hand held knot-tying guide or device which will enable the user to form or tie a proper bowline knot and then be removed from the knot, leaving a functional, fully formed bowline knot.

It is a further object of this invention to provide a hand held knot-typing guide or device which is simple of construction, economical of manufacture and convenient and simple to use.

A BRIEF DESCRIPTION OF THE DRAWINGS

REFERRING TO THE DRAWINGS

Figure 1:
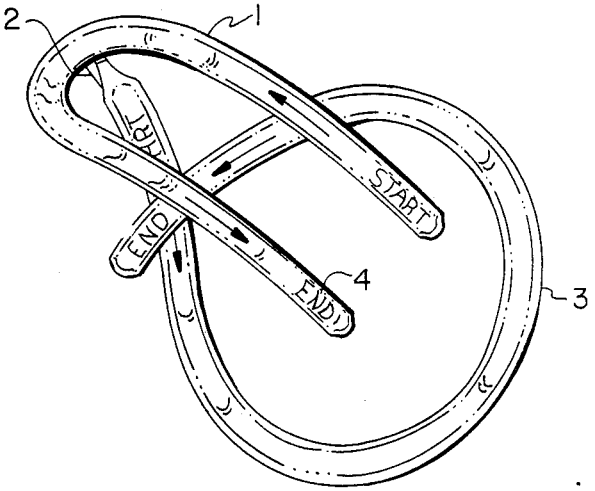
FIG. 1 is a perspective view of the Knot-tying Guide as assembled.

The knot-tying guide consists of lengths 1 and 3 (FIGS. 1 and 2) of a supportive (semi-rigid) material (soft plastic would be an example of such material), a connecting or hinging means 2 (FIGS. 1 and 2) which may incorporate one of many well known such connecting means as a ball and socket, pin and sleeve or pintle and gudgeon (for a completely separable arrangement), and an indicating or marking means 4 (FIG. 1) to show the user the proper direction to insert the cordage.

Figure 2:
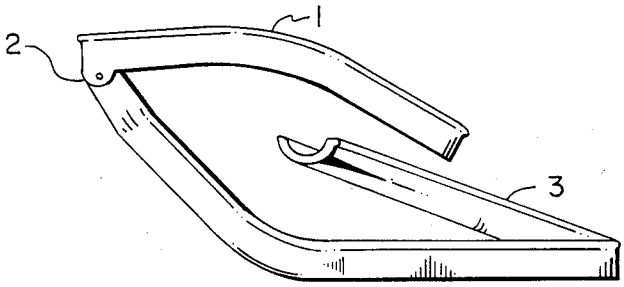
FIG. 2 is a side view of the guide of FIG. 1.
Figure 3:
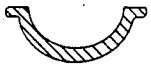
FIG. 3 is a cross section of parts 1 and 2.

In the preferred embodiment, the connecting means 2 (FIGS. 1 and 2) is located at the underside of the midpoint of the U-shaped length 1 (FIG. 2) and the uppermost terminus of the bight-shaped length 3 as seen in FIG. 2, and so arranged that a section of cordage inserted into the open bight-shaped length 3 at this point, would be encompassed by the U-shaped length 1. The termini of the U-shaped length 1 may lie in the vertical plane of the open bight, either above the horizontal plane of the open bight 3 (shown in FIG. 2) or extend downward into the open bight (not shown).

In using the device, a length of cordage would be inserted at the terminus of the open bight 3 indicated (marked "START" in FIG. 1) and advanced along the open bight 3 until adequate excess cordage was available, at the terminus of open bight 3 marked "END" (FIG. 1), to complete the knot (this amount would vary depending on user's intent and also cordage size, but would normally average between 1 and 2 feet of excess). The end of the excess cordage would then be brought down below the horizontal plane of the open bight 3 and then up through the open bight 3 and inserted into the right-hand side of the U-shaped length 1 (marked "START" in FIG. 1), drawn along and around the U-shaped length 1 to the terminus, of same marked "END" (FIG. 1) and a bowline knot has been formed.

Due to the movable or removable connecting means and also due to the clearance incorporated in the design of the open bight 3, the guide is able to be removed from the formed bowline knot.

What I claim by my invention is:

1. A knot-tying guide comprising a length of a supportive material, whose upper surface has been adapted to stabilize and hold a section of cordage, and which has been formed into the shape of an open bight wherein said bight contains space between the upper surface of the inferior section and the lower surface of the superior section where the material transverses itself in forming the bight and is attached by a connecting means at one of its termini to a U-shaped length of a supporting material, whose upper surface has also been adapted to stabilize or hold a section of cordage, in such a manner that the termini of said U-shaped length lie within the vertical plane of said open bight and in which manner the two lengths, together, provide a form of a knot for the cordage, and wherein both lengths of supportive material are marked, by an indicating means as to starting point, direction and/or end point for inserting the cordage.

* * * * *